US006216992B1

(12) United States Patent
Bisonaya et al.

(10) Patent No.: US 6,216,992 B1
(45) Date of Patent: Apr. 17, 2001

(54) MOUNTING DEVICE FOR SECURING A SINK TO A COUNTERTOP AND METHOD OF USING SAME

(75) Inventors: Rudy Y. Bisonaya, Oaklawn; Phillip J. Baranek, Westmont; Richard H. Dickson, Carol Stream; Daniel Erickson, Oak Park; Gerald J. Farrell, deceased, late of Elmhurst, by Elizabeth L. Farrell, executor; Paul Randolph Payne, Lyons; Edward Adam Przeklasa, Naperville; Dimitry Roytberg, Glenview; Anna Svehla, Berwyn, all of IL (US); Garry Perryman, Coldwater (CA); Doug Odendahl, Severn Township (CA); Frank J. Johnson, Erin (CA)

(73) Assignee: Elkay Manufacturing Company, IL (US)

( * ) Notice: Subject to any disclaimer, the term of this patent is extended or adjusted under 35 U.S.C. 154(b) by 0 days.

(21) Appl. No.: 09/262,258

(22) Filed: Mar. 4, 1999

(51) Int. Cl.[7] ..... A47B 96/06

(52) U.S. Cl. ..... 248/212; 4/633; 248/27.3; 248/201

(58) Field of Search ..... 248/227.2, 201, 248/200.1, 200, 212, 213.2, 229.16, 226.11, 27.1; 4/633, 631, 632, 634, 635, 636, 650

(56) References Cited

U.S. PATENT DOCUMENTS

| | | | | |
|---|---|---|---|---|
| 2,846,695 | * | 8/1958 | Hartog | 4/633 |
| 2,925,609 | * | 2/1960 | Richardson | 4/633 |
| 3,014,476 | * | 12/1961 | Barnett | 248/27.1 |
| 3,029,445 | * | 4/1962 | Just | 4/633 |
| 3,365,732 | * | 1/1968 | Juergens et al. | 4/634 |
| 3,613,128 | * | 10/1971 | Moyer | 4/650 |
| 3,813,707 | * | 6/1974 | Fowell | 4/187 A |
| 4,175,292 | * | 11/1979 | Morrison | 4/187 A |
| 4,432,106 | * | 2/1984 | Smith | 4/633 |
| 5,505,419 | * | 4/1996 | Gabrius | 248/343 |
| 5,538,206 | * | 7/1996 | Sather | 248/27.1 |
| 5,743,501 | * | 4/1998 | Rapp | 248/201 |

FOREIGN PATENT DOCUMENTS

| | | |
|---|---|---|
| 1019502 | 10/1977 | (CA) . |
| 1246805 | 12/1988 | (CA) . |
| 71 28 766 | 10/1971 | (DE) . |
| 297 19 860 | 2/1998 | (DE) . |
| 0 029 079 | 5/1981 | (EP) . |
| 673 001 | 5/1952 | (GB) . |
| 1 035 961 | 7/1966 | (GB) . |

* cited by examiner

*Primary Examiner*—Leslie A. Braun
*Assistant Examiner*—Tan Le
(74) *Attorney, Agent, or Firm*—Mallinckrodt & Mallinckrodt; Robert R. Mallinckrodt

(57) ABSTRACT

A sink mounting device includes a weld bracket, a movable clip member and a hanger assembly used to movably couple the clip member to the weld bracket. The weld bracket is secured to a side portion of a sink bowl and the movable clip is used to engage an overhanging portion of the underside of the countertop. The clip includes a base having an axially positioned through-opening, an elongated arm member which extends longitudinally in a direction axially from the base, a projecting finger, which extends laterally from the end of the arm remote from the base, and includes a locating flange which, when the sink mounting device is operated, engages the hanger assembly, weld bracket and/or sink bowl at a limit position to prevent further rotation of the movable arm about the axis.

24 Claims, 5 Drawing Sheets

MOUNTING DEVICE FOR SECURING A SINK TO A COUNTERTOP AND METHOD OF USING SAME

SCOPE OF THE INVENTION

The present invention relates to a mounting device which is used to secure sinks to countertops, and more particularly to a mounting device which is adapted for one hand clamping operation when operated to secure a sink in position.

BACKGROUND OF THE INVENTION

Conventional kitchen and bathroom sinks include a peripherally extending upper rim which, when installed, rests upon the top surface of the adjacent portion of the countertop. The sink is secured in place by a clamp construction which engages the underlying surface of the countertop to prevent the sink from being raised or moved sideways. Various types of mounting or clamping devices are known for securing sinks to countertops. Conventional sink clamp constructions, such as that shown in Canadian Patent No. 1,246,805 to Cappella which issued Dec. 20, 1988, typically consist of a weld bracket welded to the side of the sink and a movable clip arm member. The movable clip arm is in turn mechanically coupled to the bracket by a bolt mechanism which is threaded through an internally threaded aperture formed in the clip arm and which has a grooved end rotatably secured to the weld bracket. On rotation of the bolt, the bolt position remains constant relative to the sink. As a result, the clip arm moves axially as the bolt is turned by the threaded engagement between the bolt threads and internally threaded opening of the clip arm. Accordingly, the clip arm is moved vertically by rotating the bolt until the clip is brought into engagement with the underside of the countertop under compression to wedge the sink in place.

A disadvantage of the device disclosed in Canadian Patent No. 1,246,805 exists in that it requires the use of a customized bolt to movably couple the arm member to the weld bracket. The use of customized bolts increases the overall cost of the mounting device and hinders the simple substitution of longer or shorter bolts required to customize the mounting device for use with thicker or thinner countertops.

In addition to the increased costs associated with the manufacture of customized bolts, a further disadvantage with the Cappella mounting device exists in that as the bolt is tightened, the arm frequently turns together with the rotating bolt. This necessitates that two hands be used to operate the device when installing a sink. One hand is required to hold the clip arm in the correct orientation under the overhanging portion of the countertop and prevent its rotation out of alignment therewith, while the other hand turns the bolt. The necessity of using two hands to operate the mounting device may prevent an installer from securely holding the sink in the correct position during initial clamping. In addition, often the spacing between the rear edge of the sink bowl and the adjacent wall is insufficient to permit two-hand operation of the mounting device, with the result that as the clamp is tightened the clip arm member may rotate away from a position under the adjacent countertop overhang.

A further disadvantage of the Cappella sink mounting device exists in that as the clip arm is tightened and engages the underside of the countertop, the reaction forces at the end of the clip arm and the periphery of the screw head are concentrated on a very small area of contact with the side of the bowl. These reaction forces deform the side of the bowl, leaving an unsightly appearance.

As well, another disadvantage with the Cappella mounting device exists in that it may be used with only a limited number of sink designs. Because the weld brackets which are secured to the sides of the sink bowl often project radially therefrom up to 1 cm or more, they may interfere with the insertion of the sink bowl through the countertop hole. As such to ensure that the sink rim extends beyond the countertop hole, the Cappella mounting device may typically only be used on sinks which have a radially extending rim which extends at least 1.5 cm or more, and also the tolerance on the countertop hole must be tight to make it work.

SUMMARY OF THE INVENTION

Accordingly, the present invention overcomes at least some of the disadvantages of the prior art by providing a sink mounting device for use in securing a sink to countertops of various thicknesses, which includes a movable clip arm member used to engage the underside of the countertop. The clip arm member includes a projecting finger portion which may be selectively moved against an overhanging part of the underside of a countertop to secure the sink in place; and a locating projection, web or finger to maintain the clip arm in an optimum clamping position aligned beneath the overhanging part while the clip arm member is moved theretowards.

Another object of the invention is to provide a mounting device used to secure a sink to a countertop which includes a clip arm having a finger portion which engages a countertop to clamp the sink in place, and which is adapted to rotate through approximately 90° from a nested position wherein one side of the finger portion substantially in abutting juxtaposition with the sink bowl, to an extended position rotated away therefrom, where the finger portion may optimally engage the underside of the countertop.

Another object of the invention is to provide a mounting device which is used to secure a sink to a countertop which may be fabricated easily and inexpensively.

A further object of the invention is to provide a bolt actuated clip arm used in a sink mounting device which is engaged by the bolt so as to minimize the deflection of the clip arm during sink installation.

Another object of the invention is to provide a mounting device used for clamping a sink in a hole formed in a countertop, which includes a bolt actuated movable clip arm which automatically orients itself in an optimum clamping position as the bolt is initially turned during tightening.

Still another object of the invention is to provide a mounting device where the projecting finger portion of the clip in contact with the underside of the countertop is intentionally allowed to bend at its weakest point when a predetermined torque on the screw is reached, as for example, where a weakening slot or necked down portion connects the longitudinal arm and the finger of the clip. This method prevents permanent deformation of the sink rim and/or the side of the bowl in case the screw is over torqued.

A further object of the invention is to provide the installer a user friendly mounting device where a movable clip cannot freely rotate from its nested position, during the process of dropping the sink into the countertop hole.

A further object of the invention is to provide a mounting device used to secure a sink to a countertop and which may be used to mount sinks having either narrow or wide sink rim designs.

The present invention provides a sink mounting device which includes a weld bracket, a movable clip member and a hanger assembly used to movably couple the clip member to the weld bracket. The weld bracket is adapted to be secured to a side portion of a sink bowl by crimping, welding or the like. The movable clip is used to engage an overhanging portion of the underside of the countertop. The clip arm includes a base portion having an axially positioned through-opening therethrough, an elongated arm member which extends longitudinally in a direction generally axially from the base, and a projecting finger, pawl or such toothed end which extends laterally from the end of the arm remote from the base. Most preferably the clip arm includes a weakening slot where the projecting finger connects to the longitudinal arm. The movable clip further includes a locating flange, finger web or the like which, when the sink mounting device is operated, is configured to engage at least one of the hanger assembly, weld bracket and/or sink bowl at a limit position and prevent further rotation of the movable arm about the axis. The movable clip may preferably also include in its base portion a shorter longitudinal member located opposite and parallel to the longitudinal arm which has a fairly large area made to establish contact and slide with the side of the bowl when the screw is tightened. In a most preferred embodiment, the limit position is selected at a position whereby the projecting finger or pawl assumes an optimal clamping orientation under the overhanging portion of the countertop.

In one simplified embodiment, the hanger assembly includes a bolt which couples the movable clip to the weld bracket in essentially the same configuration as disclosed in Canadian Patent No. 1,246,805 to Cappella. More preferably, however, the hanger assembly consists of a conventional bolt having an externally threaded portion and an enlarged bolt head, and a hanger bracket adapted for securement to the weld bracket. Preferably, the weld bracket is formed as an upwardly extending hook which is received in a complementary aperture or slot formed in the hanger bracket, although other complementary weld brackets and hanger bracket configurations may also be used. The hanger bracket is provided with a laterally extending projecting portion which has an internally threaded bore formed therethrough. The threaded bore is sized to threadedly receive the threaded portion of the bolt therein. The threaded bore is positioned so that in assembly of the mounting device, the threaded bore may be axially aligned with the through-opening in the base of the movable clip.

More preferably, the through-opening in the base is elongated in the axial direction and has a radial diameter which is marginally larger than the threaded end of the bolt, but smaller than the bolt head. In one simplified construction, the base is formed from a bent ribbon of metal having an open interior structure and upper and lower surfaces formed from parallel spaced webs. Aligned apertures through the webs define the upper and lower axial extent of the through-opening. It is to be appreciated that the engagement of the bolt by axially spaced webs which define the apertures maintains the clip member and its projecting portion in a fixed orientation relative to the axis as the bolt is turned.

The construction of the mounting device enables its one handed operation to facilitate the installation and securement of a sink. As the bolt is initially rotated, its threaded engagement with the threaded bore in the hanger bracket draws the bolt axially towards the countertop. On initial rotation of the bolt, the clip member also rotates about the through-opening axis until the clip member assumes the limit position where the locating web or finger engages one or more of the bolt, hanger bracket, the weld bracket or sink, to prevent further rotation of the clip member. As the bolt moves axially through the threaded bore, the engagement of the bolt head with the clip base urges the clip towards the countertop to bring the projecting portion of the clip member against the underside of the countertop.

The hooked configuration of the weld bracket advantageously permits the invention to be used with either thin rim or wide rim sinks. When installing thin rim sinks, such as those having a rim dimension of less than 1.5 cm, a hole may be formed in the countertop having a size only marginally greater than the sink bowl. A sink bowl shipped without the hanger brackets, bolts and clips is dropped into place in a suitable hole with the sink rim overlying the adjacent countertop. Hanger brackets already assembled with clips and bolts are then hooked up to each weld bracket. The sink is then secured to the countertop by tightening the bolts.

Where wide rim sinks are used, which have a peripherally extending rim extending 1.5 cm or more, the hanger assembly and movable clip member may be mounted to the weld bracket at the factory and shipped as a fully assembled unit. In factory assembly, the hanger bracket is slid onto the hook of the weld bracket. The bolt is inserted upwardly through the through-opening in the bottom of the clip base and into threaded engagement with the hanger bracket bore. The movable clip member is then rotated relative to the bolt axis to a nested position so that an edge of the projecting finger or pawl portion of the clip member is adjacent to and more preferably abuts a side of the sink bowl. In this configuration, the mounting device is positioned so as to assume a minimal profile and the sink may be dropped into position in the countertop hole, without requiring disassembly of the sink mounting mechanism.

Once the sink is positioned in the hole, the bolt is then rotated, initially rotating the clip member therewith about the axis to the limit position. Once the clip arm assumes the limit position, the threaded engagement of the bolt within the hanger bracket bore moves the bolt axially towards the countertop, with the engagement of the bolt head with the clip base in turn urging the clip member in axial movement. While the bolt is tightened, its engagement with the base at axially spaced locations prevents the clip member from deflecting out of an optimum clamping position as the projecting pawl of the clip is brought into contact with the underside of the countertop.

Accordingly, in one aspect the present invention resides in combination, a sink and a mounting device for securing the sink to a countertop, the mounting device comprising a bracket secured to a side portion of the sink, a movable clip, and a hanger assembly for coupling the movable clip to the bracket, the movable clip including a base having an axially extending through-opening therethrough, an arm member extending generally in the axial direction longitudinally from the base, a shorter longitudinal member opposite and parallel with the arm member adapted to slide and bear against the side of the bowl in a fairly large area, and a projecting portion extending laterally from an end portion of said arm member remote from the base and adapted to engage an underside of the countertop, the hanger assembly including a bolt having a threaded portion aligned with the axis and a bolt head, the threaded portion having a diameter selected to permit its relative axial movement in the through-opening, and the bolt head having enlarged diameter portion selected larger than the through-opening to prevent movement of the bolt head therepast, wherein rotation of the bolt about the axis in a first direction moves the movable clip axially relative to the bracket to selectively urge the projecting portion into engagement with the underside of the countertop, and wherein the movable clip includes a projecting flange configured to engage at least one of said hanger assembly, said bracket and said sink at a limit position to prevent further rotation of said movable clip member in the first direction as the bolt is rotated.

In another aspect, the present invention resides in a method of using a clamp assembly to secure a sink to a countertop, the sink including a bowl having a peripherally extending rim adapted to engage an upper surface of the countertop and a bracket mounted to a side of said bowl at a location below said rim, the clamp assembly including, a bolt having a bolt head and a threaded portion, a hanger member configured to engage said bracket and couple the hanger member thereto and having a threaded bore sized to threadedly receive the threaded portion of the bolt therein, whereby when the keeper member is secured to the bracket the rotation of the bolt in a first direction moves the threaded portion through the threaded bore towards the sink rim, a movable clip member adapted to engage an underside of the countertop, the movable clip member including a base having an axially positioned opening therethrough sized to permit substantially free sliding movement of the threaded portion of the bolt therein while preventing movement of the head therethrough, an arm member extending longitudinally generally in the axial direction from the base and including a projecting flange configured to engage at least one of said hanger member, said bracket, said bowl and said bolt at a limit position to prevent further rotation of the clip in the first direction, a shorter longitudinal member opposite and parallel to the arm member adapted to slide and bear against the side of the bowl distributing the reaction force of the clip in a fairly large area to the side of the bowl, said sink being secured to the countertop by the steps of:

(a) forming a hole in said countertop sized to receive the bowl therein in a complementary fit manner;

(b) inserting the bowl into the hole to position the rim in engagement with the upper surface; and (c) with the hanger member secured to the bracket and the threaded portion of the bolt inserted through the opening and into threaded engagement with the threaded bore, rotating the bolt in the first direction to move the bolt axially toward the sink rim to axially move the clip into engagement with the underside of the countertop, wherein the rotation of the clip about the axis moves the projecting flange into engagement with said at least one of said hanger member, said bracket, said bowl and said bolt to maintain said clip at said limit position as said clip is moved axially.

In a further aspect, the present invention resides in combination, a sink and a mounting device for securing the sink to a countertop, the mounting device comprising a bracket secured to a side portion of the sink, a movable clip and a hanger assembly for coupling the movable clip to the bracket, the movable clip being adapted to engage an underside of the countertop and including a base having an axially positioned through-opening therethrough and an arm member extending generally in the axial direction longitudinally from the base, the hanger assembly including a hanger member having an axially aligned internally threaded bore therethrough, and a bolt having a threaded portion and a bolt head, the threaded portion having a diameter selected to permit its sliding axial movement in the through-opening and its threaded engagement with the threaded bore, the bolt head having enlarged diameter portion selected larger than the through-opening, wherein with the threaded portion of the bolt slid axially through the through-opening and into threaded engagement with the threaded bore the engagement of the bolt head with the base as the bolt is rotated in a first direction about the axis urges the clip axially towards the countertop, and at least one of the movable clip, bracket and hanger member including a projecting flange configured to prevent further rotation of said movable clip member in the first direction beyond a limit position as the bolt is rotated.

More preferably, included in the base is a shorter longitudinal member located opposite and parallel to the arm member. It is adapted to slide on the side of the bowl when the screw is rotated to distribute the reaction force of the clip over a sufficiently large area so as not to create an unsightly deformed portion on the side of the bowl. The shorter longitudinal member also provides added clearance space between the side of the bowl and a socket wrench or similar devices used to drive the bolt in installing or removing the sink.

BRIEF DESCRIPTION OF THE DRAWINGS

Further aspects and advantages of the present invention will appear from the following description taken together with the accompanying drawings in which.

DETAILED DESCRIPTION OF THE INVENTION

Figure 1:
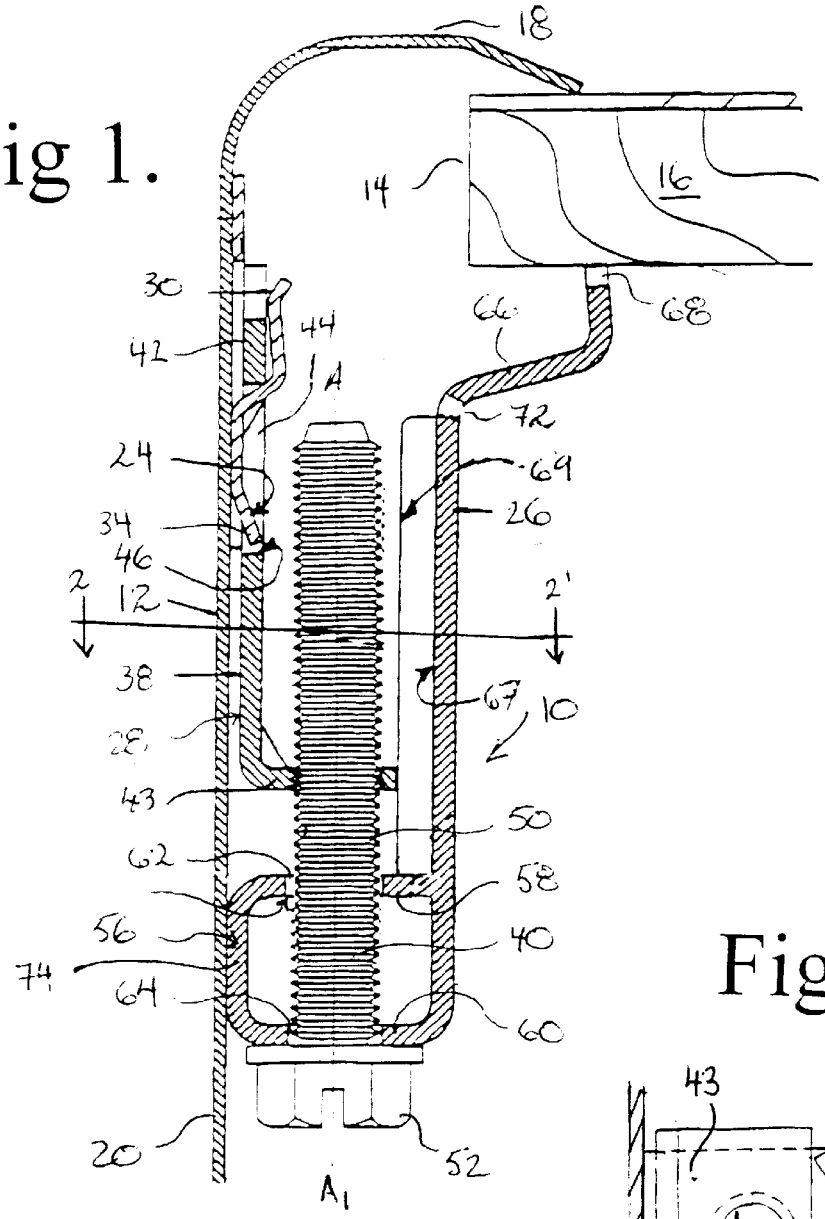
FIG. 1 is a partial sectional view of the mounting assembly securing a sink in a clamped position in accordance with a preferred embodiment of the invention.
Figure 2:
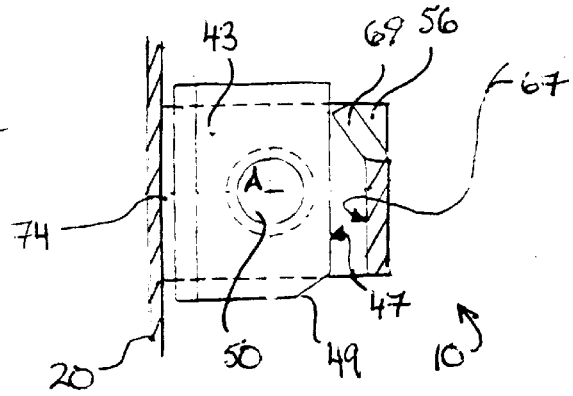
FIG. 2 is a cross-sectional view of the mounting assembly shown in FIG. 1 taken along line 2–2'.
Figure 3:
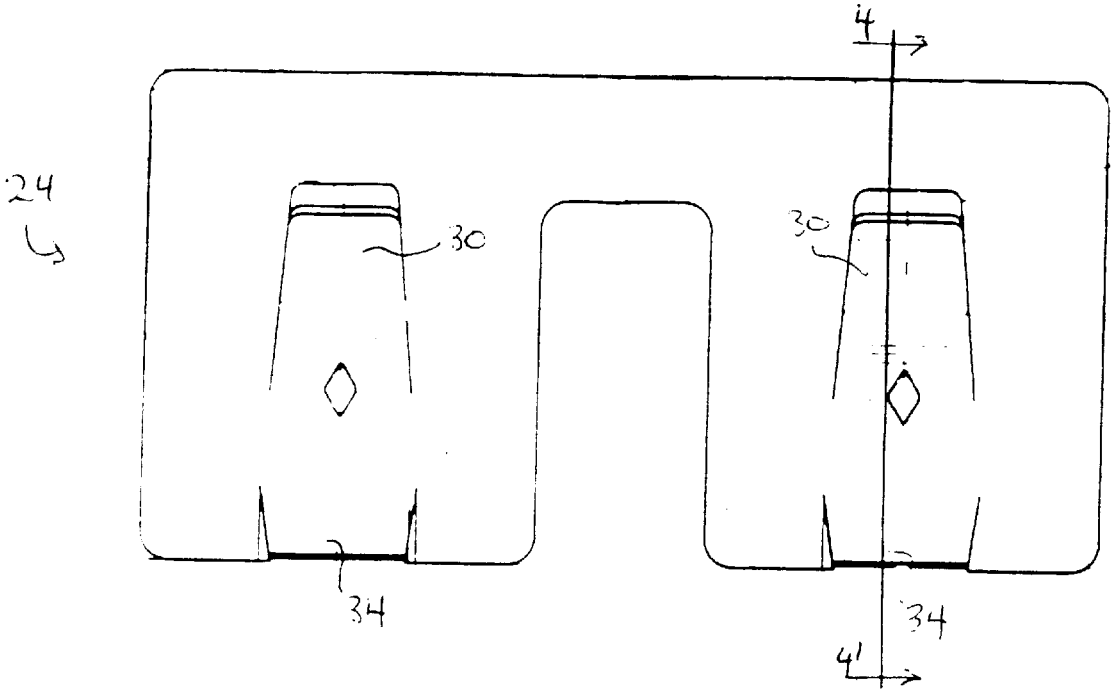
FIG. 3 is a perspective view of the weld bracket shown in FIG. 1.

Reference is first made to FIGS. 1 and 2 which show a mounting assembly 10 used to secure a sink 12 in a hole 14 formed in a countertop 16. In the embodiment shown, the sink 12 is of a wide rim type having an upper peripherally extending rim 18 which extends radially outwardly a distance of at least 1.5 cm more from the sink bowl 20.

Although FIG. 1 shows a partial view of the sink countertop 16, it is to be appreciated that the hole 14 is formed in the countertop 16 with a generally corresponding shape to that of the sink bowl 20. The rim 18 of the sink 12 is adapted for moderate flexure to allow the sink 12 to be drawn down to the countertop 16 to create a tight seal between the sink rim 18 and the top of the countertop 16 with the use of a caulking compound or gasket therebetween.

The mounting assembly 10 consists of a weld bracket 24, which is welded to the side of the sink bowl 20, a movable clip 26 which in use engages the underside of the countertop 16 to secure the sink 12 in place, and a hanger assembly 28 used to movably couple the clip 26 to the weld bracket 24.

The weld bracket 24 is shown best in FIGS. 1 to 4 as being welded to the side of the sink bowl 20 at a location between about 2 and 6 cm beneath the sink rim 18. The weld bracket 24 is formed by stamping from a thin sheet of steel and has at least one, and more preferably, two identical hook members 30. As is shown in FIG. 1, the weld bracket 24 is secured to the bowl 20 so that each hook member 30 extends at an angle laterally outwardly from the bowl 20 and upwardly towards the countertop 16, defining a narrow upwardly open bight 32 therein. Associated with each hook member is a lanced tab 34 which projects downwardly and laterally outward beneath each hook 30. Preferably, the tabs 34 do not extend laterally outwardly from the sink bowl 20 to the same extent as the hook members 30. As will be described hereafter, the lanced tabs 34 act to maintain the hanger assembly 28 in a position secured to a sink bowl 20 during the operation of the mounting assembly 10.

The hanger assembly 28 consists of an L-shaped hanger bracket or hanger 38 and an elongated threaded bolt 40. The hanger bracket 38 as shown in FIGS. 1, 2, 5 and 6 is formed from a bent flattened ribbon of steel and includes an elongated keeper portion 42 which is adapted for coupling to the weld bracket 24, and a laterally extending projecting portion 43. A rectangular opening 44 is formed in the upper part of the keeper portion 42 which is configured so that the hanger brackets 38 may be secured to the sink 12 by inserting the hook member 30 therethrough in the manner shown in FIG. 1. As is apparent, when the hanger bracket 38 is suspended in the bight 32 of the hook member 30, the lanced tab 34 preferably locates immediately above a lowermost edge 46 of the bracket opening 44. The engagement of the tab 34 with the edge 46 thus prevents the hanger bracket 38 from being slid directly upward out of the hook bight 32.

The projecting portion 43 extends at approximately 90° from the keeper portion 42, so as to extend outwardly substantially perpendicular from the sink bowl 20 when the hanger bracket 38 is secured in position to the hook 30. An internally threaded bore 48 is formed through the middle of the projecting portion 43. FIG. 2 shows the portion 43 in top view as being generally rectangular and extending from the keeper portion 42 to an outer edge 47. The projecting portion 43 further includes a beveled corner portion 49 which extends into the edge 47.

Figure 4:
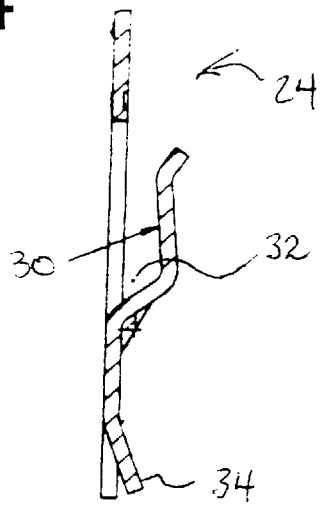
FIG. 4 is a cross-sectional view of the weld bracket shown in FIG. 3 taken along lines 4–4'.
Figure 5:
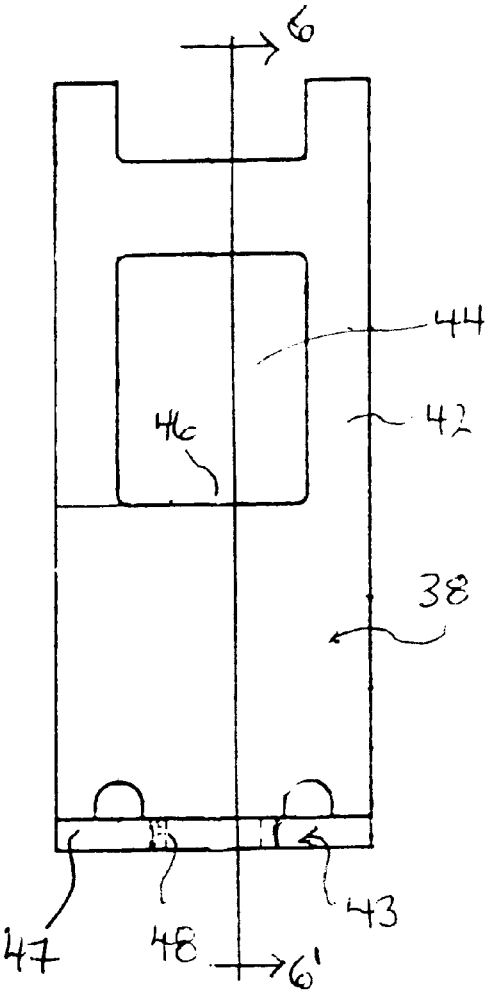
FIG. 5 is perspective front view of the hanger bracket shown in FIG. 1.
Figure 6:
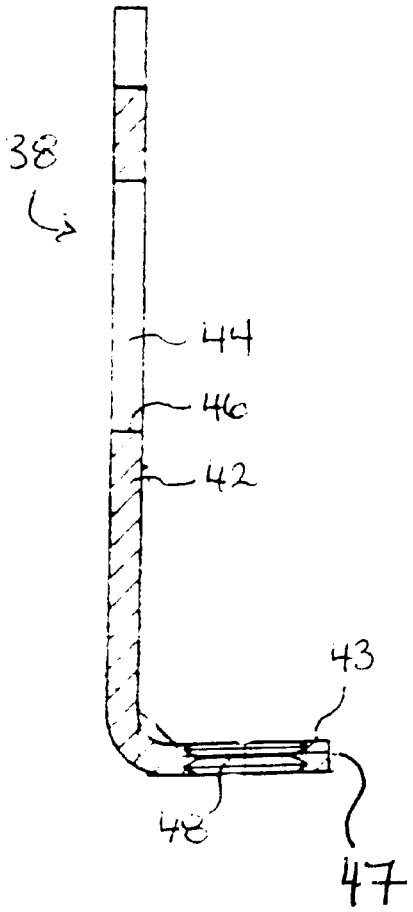
FIG. 6 is a cross-sectional view of the hanger bracket shown in FIG. 5 taken along line 6–6'.

FIGS. 2 and 4 show best the beveled comer portion 49 as being provided to permit substantially unhindered rotation of the clip 26 about the axis $A–A_1$ to a limit position shown in FIG. 2. It is to be appreciated, however, that other hanger bracket configurations are also possible.

FIG. 1 shows the bolt 40 as being of a stock construction having an elongated externally threaded portion 50, and a larger diameter bolt head 52. The diameter of the threaded portion 50 of the bolt 40 is selected to threadedly engage the internally threaded bore 48 of the hanger bracket 38, whereby the rotation of the bolt 40 results in its movement through the bore 48.

Figure 7:
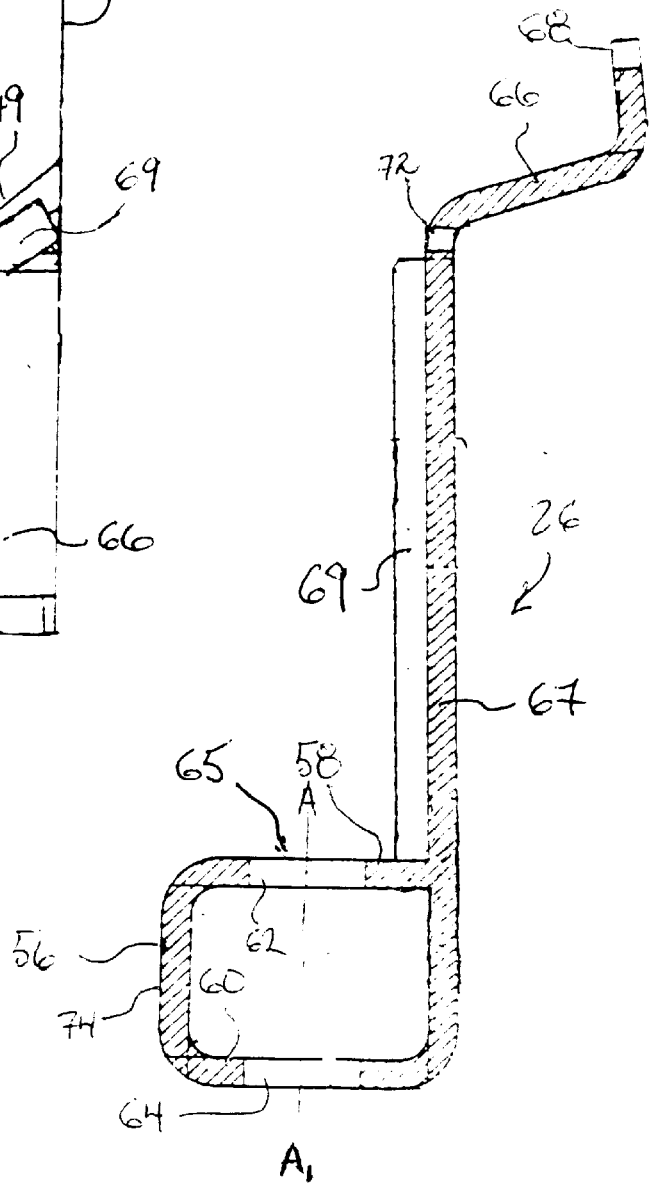
FIG. 7 is a perspective view of the clip member shown in FIG. 1.

FIGS. 1, 2 and 7 show best the movable clip 26 which is preferably formed from bending a single blank of steel ribbon. The clip 26 includes a generally rectangular base 56, defined in part by upper and lower parallel spaced webs 58,60. A pair of aligned apertures 62,64 in each of the upper and lower webs 58, 60, respectively, define the upper and lower extent of a through-opening 65 which extends along an axis $A–A_1$ through the base 56. The through-opening 65 has a minimum diameter marginally greater than the outermost diameter of the threaded portion 50 of the bolt 40, but smaller than the diameter of the bolt head 52, thereby permitting the threaded portion 50 of the bolt 40 to be slid axially therein. The through-opening 65 is formed in the clip base 56 so as to permit the axial alignment of the through-opening 65, the threaded bore 48 of the hanger bracket 38 and the threaded portion 50 of the bolt 40. An arm member 67 extends longitudinally generally in the axial direction from the base 56. As shown best in FIG. 7, the arm member 67 is formed as a generally planar elongated web of metal which is bent at approximately 55° substantially along one edge, to define an angularly extending locating flange 69 which extends substantially along the axial length of the arm member 67. The end of the arm member 67 which is remote from the base 56 merges with a laterally extending finger portion 66 which preferably terminates in a plurality of axially projecting teeth or fingers 68. As is apparent from FIG. 1, on tightening of the movable clip 26, it is the fingers 68 which engage the underside of the countertop 16, to firmly secure the sink 12 in place within the hole 14.

Although not essential, a lateral slot 72 is formed partway across the clip 26 where the arm member 67 and finger portion 66 merge. The slot 72 extends a distance selected to provide the clip 26 with a desired point of weakness. More particularly, the slot 72 has an extent chosen to permit bending of the clip and the finger portion 66 to deflect relative to the arm member 67 when the bolt 40 is turned with a predetermined torque. The predetermined torque is selected greater than the torque required to pull the rim 18 of the sink 12 down snuggly onto the upper surface of the countertop 16, but less than that required to cause permanent deformation of either of the rim 18 or the side of the sink bowl 20. It is to be appreciated that this advantageously prevents deformation of the sink rim 18 or bowl 40 in the event the bolt 40 is overtightened.

More preferably, as shown best in FIG. 2, the base 56 is elongated in the lateral direction at which the projecting finger portion 66 extends from the arm member 67. The clip 26 is preferably selected with a width which substantially corresponds to the lateral extent of the projecting portion 43 of the hanger bracket 38. With this configuration, the clip 26 may be rotated 90° about the axis $A–A_1$ between a nested position shown in FIG. 8 in which a lateral edge of the clip finger portion 66 is moved towards abutting contact with the sink bowl 20. When the clip 26 is moved to the nested position, the locating flange 69 is brought into alignment with the beveled corner edge 49 of the hanger bracket 38. Because the width of the clip 26 is substantially at or smaller than the distance the projecting portion 43 laterally extends, the movable clip 26 does not substantially project outwardly from the sink bowl 20 beyond the hanger bracket 38. As will be described hereafter, this permits the hanger assembly 28 and movable clip 26 to be secured to the weld bracket 24 prior to installation of a wide rim sink 12.

The longitudinal side portion 74 of the base 56 which is spaced from and generally parallel, the arm member 67 is formed with a sufficiently large surface area so as to dissipate any contact in forces between the clip 26 and sink 12 over a fairly wide area of the side of the bowl 20. Most preferably the side portion 74 has an area of at least 0.75 $cm^2$.

To install a wide rimmed sink 12, a complementary shaped hole 14 is first formed through the countertop 16. The hole 14 is sized smaller than the peripheral extent of the sink rim 18, but large enough to permit the sink bowl 20, weld brackets 24 and hanger brackets 38 to be lowered therethrough, so that the sink rim 18 may be moved into position resting on the countertop 16.

Preferably, the radius of the hole 14 is approximately 1 cm greater than the radial extent of the sink bowl 20.

Either at the factory or immediately prior to inserting the sink 12 into the hole 14, movable clip 26 is initially rotated about the axis $A–A_1$ to the nested position, after the hanger 38 and movable clip 26 are coupled to the sink 12. In initial placement, the threaded portion 50 of the bolt 40 is aligned with the axis $A–A_1$ and inserted upwardly through the bottom of the clip base 56 and into threaded engagement with the threaded bore 48. Because the through-opening 65 is sized larger than the threaded end 50 of the bolt 40, the clip 26 moves to rest with the web 60 resting against the bolt head 52.

Figure 8:
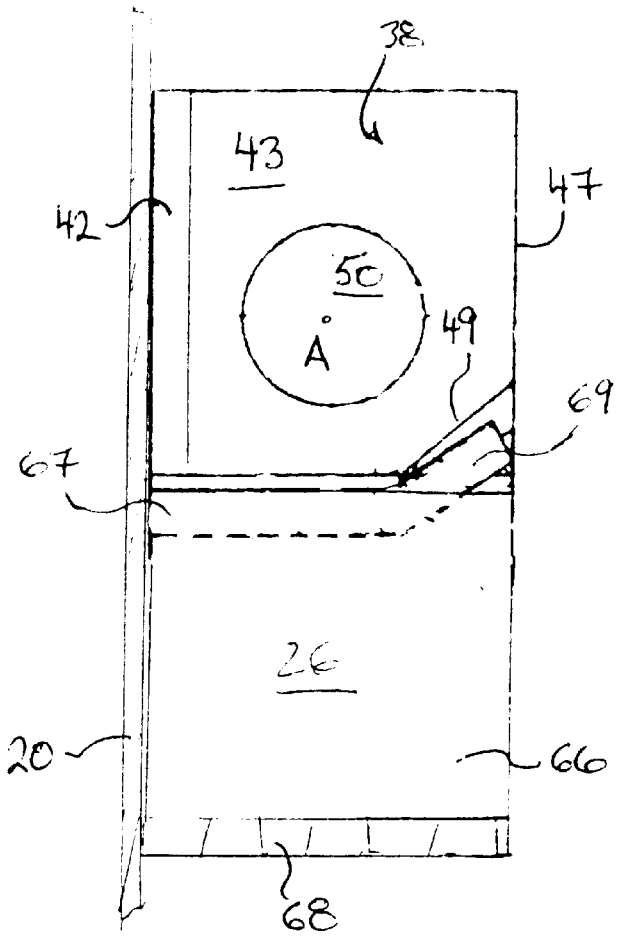
FIG. 8 is an enlarged perspective top view of the mounting assembly shown in FIG. 1, with the clip member moved to a nested position.

An advantage of the present invention exists in that when the clip 26 is moved to the nested position shown in FIG. 8, the arm member 67 marginally engages a side edge of the projecting portion 43. The engagement of the arm member 67 with the projecting portion 43 acts to lock the clip 26 in the nested position. The result is that the clip 26 may not rotate from the nested position until a predetermined minimum rotational force is applied, as for example by rotating the bolt 40 with a required torque. This advantageously ensures that during installation the clip 26 will not rotate from the side of the sink bowl 20, where it may otherwise interfere with the movement of the sink 12 into the hole 14.

Figure 9:
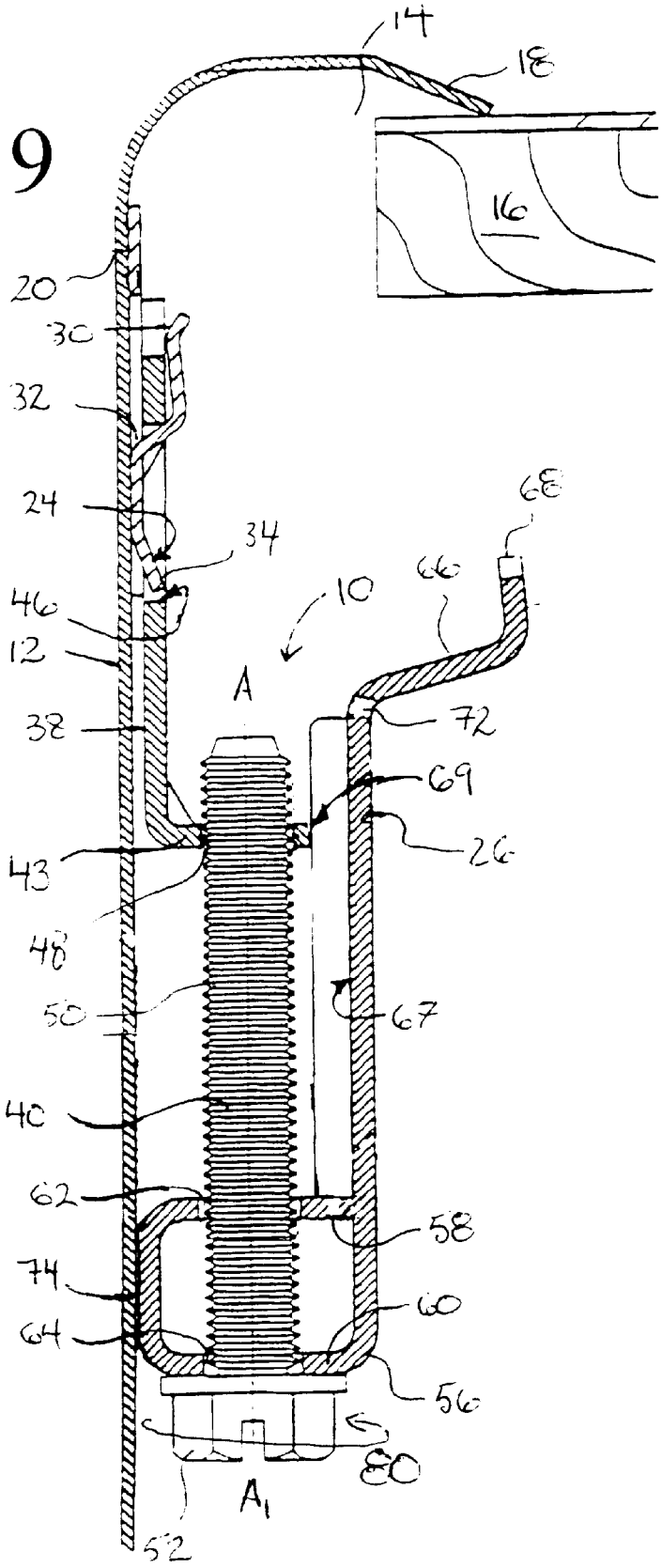
FIG. 9 is a partial sectional view of the mounting assembly shown in FIG. 1 prior to clamping, with the clip moved to a limit position.

On initially rotating the bolt 40 in the direction of arrow 80 (shown in FIG. 9) with the predetermined minimum torque to tighten the bolt 40, the movable clip 26 rotates about axis $A–A_1$ together with the bolt head 52. The clip 26 rotates so that the finger 66 swings away from the nested position, until the projecting flange 69 contacts the edge 47 of the hanger 38 at the position shown in FIG. 9, thereby limiting further movement of the clip 26 about the axis. It is to be appreciated that the flange 69 is configured to limit rotational movement of the clip 26 past the position where the finger portion 66 may be brought upwardly into engagement with the desired portion of the countertop. Most preferably, the limit position is selected so that the angular projecting finger portion 66 extends radially outwardly away from the sink bowl 20, and the side portion 74 of the clip base 56 is moved into sliding contact with the side of the bowl 20.

As the bolt 40 is tightened, it is drawn upwardly through the threaded bore 48 with the hanger 38 maintained on the weld bracket 24 against any upward forces on the bolt 40 by the engagement of the tab 34 with the lower edge 46 of the hanger bracket opening. As the bolt 40 moves upwardly towards the rim 18 relative to the hanger 38, the engagement of the larger diameter bolt head 52 with the bottom web 60 of the clip base 56 also urges the movable clip axially upward with the side portion 74 maintained in sliding contact with the sink 12. Because the clip 26 engages the bolt 40 at each of the spaced apertures 62,64, the arm member 67 is maintained substantially aligned with the axis $A–A_1$ and deflection of the clip 26 is substantially eliminated. As the clip 26 initially contacts the underside of the countertop 16, the teeth 68 bite into the countertop 16, and the rotational force of the bolt 40 pulls the hanger 38 securely into the bight 32, as the sink 12 is clamped into position. Further, because of the surface area of the side portion 74, the contact forces between the bowl 20 and base 56 which occur as the finger portion 66 is forced against the countertop 16, are dissipated over a comparatively wide area, lessening the likelihood the side of the bowl 20 may be deformed.

It is to be appreciated that if removal of the sink 12 is desired, the bolt 40 is simply rotated in the counter direction to arrow 80, lowering the bolt 40 and clip 26 relative to the hanger bracket 38.

While the preferred embodiment of the invention discloses the use of the mounting assembly 10 in securing a wide rim sink 12, the present invention is also suitable for use in securing narrower rim sinks which have a rim dimension of less than 1.5 cm as is described hereafter with like reference numerals identifying like components. In installing a narrower rim sink 12, the hole 14 would be formed only marginally greater than the sink bowl 20 and with a radial diameter less than that of the narrower rim 18. The sink 12 is shipped without the hangers 38, bolts 40 and clips 26 attached as it is lowered into position in the hole 14.

It is to be appreciated that the upwardly extending hook 30 configuration of the weld bracket 24 is particularly suited for narrow rim sinks 12.

Following the insertion of the sink 12 in the hole 14, and with the rim 18 resting on the upper surface of the countertop 16, the hanger 38, with the clip 26 and bolt 40 preassembled thereto is attached to the weld bracket 24. The preassembled clip 26, bolt 40 and hanger 38 is reattached by hooking the hanger 38 onto the hook 30 so that the hook 30 is inserted through the hanger opening 44. Thereafter the bolt 40 is tightened by turning in the direction of arrow 80 (FIG. 9) until the clip 26 is urged upwardly together with the bolt head 52 to bring the teeth 68 of the projecting portion 66 into engagement with the underside of the countertop 18. Again, with the initial rotation of the bolt 40, the clip 26 will rotate about axis $A–A_1$ until the flange 69 contacts the edge 47 at the limit position.

It is to be appreciated that because the engagement of the projecting flange with the hanger bracket edge 47 limits further rotational movement of the movable clip 26, there is no need to hold the clip 26 in the correct position during tightening of the bolt 40, and the mounting assembly bolt 40 may be tightened with single hand operation.

The use of an axially extending projecting flange 69 along the entire length of the arm member 67 advantageously ensures that the movable clip 26 is maintained in the optimum limit position as it is slid axially upward. It is to be appreciated, however, that other flange constructions or engagement members used to maintain the clip 26 in the desired orientation are also possible and will now become apparent.

While the preferred embodiment of the invention discloses a two-part hanger assembly used to mount the movable clip 26, the invention is not so limited. By way of one non-limiting example, the hanger could be omitted and a weld bracket similar to that shown in Canadian Patent No. 1,246,805 could be substituted without departing from the spirit and scope of the present invention. Another alternative is to integrate into the weld bracket a laterally extending portion with a threaded hole or holes to accept the bolt.

It is to be appreciated that while a hooked shaped weld bracket 24 and slotted hanger bracket 38 provide a simplified construction, other configurations of movably securing the clip 26 to the sink 20 are possible, including by way of non-limiting example prongs, clasps and other mechanical fasteners.

While the present invention discloses the arm member 67 as including a locating flange 69 for use in orienting the clip 26 at the limit position, the invention is not so limited. Although less preferred, a locating flange or finger used to engage the arm member 67 or base 56 and prevent clip movement past the limit position could equally be provided on one or more of the hanger 38 or weld bracket 24.

While the preferred embodiment of the invention discloses the clip 26 as being formed from a single blank of steel which is bent to define a base 56 having the upper and lower webs 58,60, the invention is not so limited. If desired, the base could be formed as a solid cast member or as a planar web of plastic or other metal, with a secondary support being provided to the bolt 40.

Although the detailed description of the invention describes and illustrates many preferred embodiments, the invention is not so limited. Many modifications and variations will now appear to persons skilled in the art. For a definition of the invention, reference may be had to the appended claims.

We claim:

1. In combination, a sink and a mounting device for securing the sink to a countertop, the mounting device comprising a bracket secured to a side portion of the sink, a movable clip, and a hanger assembly for coupling the movable clip to the bracket, the movable clip including a base having an axially extending through-opening aligned with an axis therethrough, an arm member extending generally in the axial direction longitudinally from the base, and a projecting portion ex tending laterally from an end portion of said arm member remote from the base and adapted to engage an underside of the countertop, the hanger assembly including a bolt having a threaded portion aligned with the axis and a bolt head, the threaded portion having a diameter selected to permit its relative axial movement in the through-opening, and the bolt head having enlarged diameter portion selected larger than the through-opening to prevent movement of the bolt head therepast, wherein rotation of the bolt about the axis in a first direction moves the movable clip axially relative to the bracket to selectively urge the projecting portion into engagement with the underside of the countertop, and wherein the movable clip includes a projecting flange configured to engage at least one of said hanger assembly, said bracket and said sink at a limit position to prevent further rotation of said movable clip member in the first direction as the bolt is rotated.

2. The combination as claimed in claim 1 wherein the bracket includes a hooked portion, and said hanger assembly further includes a hanger member, the hanger member including first and second portions, the first portion adapted for mating engagement with said hooked portion to secure said hanger member to said bracket, the second portion extending angularly from the first portion and having an internally threaded bore adapted for axial alignment with the through-opening on the base of the clip, the threaded bore sized to threadedly receive therein the threaded portion of the bolt, and wherein the through-opening of the base is sized to permit substantially free axial sliding movement of the threaded portion of the bolt therethrough.

3. The combination as claimed in claim 2 wherein said projecting flange extends from an edge portion of said arm member so as to engage said hanger member when said clip is moved to said limit position.

4. The combination as claimed in claim 1 wherein the projecting portion extends laterally from an end portion of said arm member remote from said base, and wherein on initial rotation of the bolt, the movable clip is rotatable about the axis in the first direction from a nested position wherein the projecting portion is positioned adjacent said side portion of the sink to the limit position, wherein the projecting portion is moved to a position spaced from said side portion.

5. The combination as claimed in claim 2 wherein said base includes a pair of parallel, spaced apart upper and lower webs and said through-opening comprises axially aligned apertures formed in each of said webs, said bolt head engaging the lower web to move said clip axially as said bolt is rotated in said threaded bore.

6. The combination as claimed in claim 5 wherein said projecting flange extends from an edge portion of said arm member so as to engage said hanger member when said clip is moved to said limit position.

7. The combination as claimed in claim 5 wherein the projecting portion extends laterally from an end portion of said arm member remote from said base, and wherein on initial rotation of the bolt, the movable clip is rotatable about the axis in the first direction from a nested position wherein the projecting portion is positioned adjacent said side portion of the sink to the limit position, wherein the projecting portion is moved to a position remote from said side portion.

8. The combination as claimed in claim 1 wherein the projecting portion includes at least one tooth for engaging the underside of the countertop.

9. The combination as claimed in claim 1 wherein the projecting flange extends substantially along the axial length of the arm member.

10. The combination as claimed in claim 2 wherein said clip has a maximum width selected substantially the same as a distance said second portion extends from said side portion of said sink.

11. The combination as claimed in claim 7 wherein said clip has a maximum width selected substantially the same as a distance said second portion extends from said side portion of said sink.

12. A method of using a clamp assembly to secure a sink to a countertop, the sink including a bowl having a peripherally extending rim adapted to engage an upper surface of the countertop and a bracket mounted to a side of said bowl at a location below said rim, the clamp assembly including, a bolt having a bolt head and a threaded portion, a hanger member configured to engage said bracket and couple the hanger member thereto and having a threaded bore size to threadedly receive the threaded portion of the bolt therein, whereby when the hanger member is secured to the bracket the rotation of the bolt in a first direction moves the threaded portion through the threaded bore towards the sink rim, a movable clip member adapted to engage an underside of the countertop, the movable clip member including a base having an opening therethrough positioned on an axis and sized to permit substantially free sliding movement of the threaded portion of the bolt therein while preventing movement of the head therethrough, an arm member extending longitudinally generally in a direction of said axis from the base and including a projecting flange configured to engage at least one of said hanger member, said bracket, said bowl and said bolt at a limit position to prevent further rotation of the clip in the first direction, said sink being secured to the countertop by the steps of:

(a) forming a hole in said countertop sized to receive the bowl therein in a complementary fit manner;

(b) Inserting the bowl into the hole to position the rim in engagement with the upper surface; and (c) With the hanger member secured to the bracket and the threaded portion of the bolt inserted through the opening and into threaded engagement with the threaded bore, rotating the bolt in the first direction to move the bolt axially toward the sink rim to axially move the clip into engagement with the underside of the countertop, and wherein the rotation of the clip about the axis moves the projecting flange into engagement with said at least one of said hanger member, said bracket, said bowl and said bolt to maintain said clip at said limit position as said clip is moved axially.

13. The method of claim 12 wherein after said step of inserting the bowl in the hole, including the further steps of securing said hanger member to said bracket, and inserting said bolt through the base opening and into threaded engagement with the threaded base.

14. The method of claim 12 wherein said clip further includes a laterally projecting finger for engaging the underside of the countertop and wherein prior to said step of inserting the bowl in the hole, including the further steps of securing said hanger member to said bracket, inserting said bolt through the base opening and into threaded engagement with the threaded base, and rotating said clip about said axis in a second direction opposite to said first direction to a nested position wherein said projecting finger is moved adjacent to said sink bowl.

15. The method of claim 14 wherein in said nested position said clip engages said hanger member to prevent rotation of the clip about the axis under a rotational force not exceeding a predetermined minimum force.

16. The method of claim 14 wherein said clip has a width selected so that when moved to the nested position, the clip does not extend laterally from the sink bowl substantially beyond the hanger member.

17. In combination, a sink and a mounting device for securing the sink to a countertop, the mounting device comprising a bracket secured to a side portion of the sink, a movable clip and a hanger assembly for coupling the movable clip to the bracket, The movable clip being adapted to engage an underside of the countertop and including a base having a through-opening therethrough positioned on an axis and an arm member extending generally in a direction of said axis longitudinally from the base, the hanger assembly including a hanger member having an axially aligned internally threaded bore therethrough, and a bolt having a threaded portion and a bolt head, the threaded portion having a diameter selected to permit its sliding axial movement in the through-opening and its threaded engagement with the threaded bore, the bolt head having enlarged diameter portion selected larger than the through-opening, wherein with the threaded portion of the bolt slid axially through the through-opening and into threaded engagement with the threaded bore the engagement of the bolt head with the base as the bolt is rotated in a first direction about the axis urges the clip axially towards the countertop, and at least one of the movable clip, bracket and hanger member including a projecting flange configured to prevent further rotation of said movable clip member in the first direction beyond a limit position as the bolt is rotated.

18. The combination as claimed in claim 17 wherein the bracket includes a hooked portion and said hanger member includes first and second portions, the first portion adapted for mating engagement with said hooked portion to secure said hanger member to said bracket, the second portion extending angularly from the first portion with the internally threaded bore located therein.

19. The combination as claimed in claim 17 wherein said projecting flange is provided on said clip and extends said flange axially substantially the length of said arm member.

20. The combination as claimed in claim 19 wherein the clip further comprises a projecting portion extending laterally from an end portion of said arm member remote from said base, and wherein on initial rotation of the bolt, the movable clip is rotatable about the axis in the first direction from a nested position to the limit position, wherein at the nested position the projecting portion is positioned adjacent said side portion of the sink, and at the limit position, the projecting portion is moved to a position remote from said side portion.

21. In the combination as claimed in claim 20, wherein said clip has a width selected so that when moved to the nested position, the clip does not extend laterally from the side portion substantially beyond the hanger member.

22. The combination as claimed in claim 1, wherein the sink includes a peripherally extending rim, the movable clip further including a weakened portion connecting the arm member and the projecting portion, and wherein the laterally projecting portion is adapted to bend relative to the arm member at the weakened portion upon rotating the bolt in the first direction with a predetermined torque, said pre-determined torque being selected greater than the torque required to pull down the rim of the sink to a top surface of the countertop, but less than that required to cause permanent deformation of the rim or the side portion of the sink.

23. The combination as claimed in claim 2, wherein said arm member extends generally in the axial direction so as to engage the lateral portion of the hanger member in the nested position, said engagement causing the movable clip and the hanger member to lock to each other until a pre-determined torque is applied on the bolt in the first direction and rotate the clip to the limit position.

24. The combination as claimed in claim 1, wherein said base of the clip includes a shorter longitudinal member spaced from and generally parallel to the arm member, the longitudinal member adapted to slidably move along the side portion of the sink as the bolt is rotated to provide increased clearance between the side portion and bolt head and distribute contact forces between the clip to the side of the bowl to substantially prevent deformation of the side portion.

* * * * *